US008205870B2

(12) United States Patent
Nakagawa

(10) Patent No.: US 8,205,870 B2
(45) Date of Patent: Jun. 26, 2012

(54) PAPER FEEDING DEVICE AND PROGRAM FOR CONTROLLING THE SAME

(75) Inventor: Tomohiro Nakagawa, Fukuoka (JP)

(73) Assignee: Seiko Epson Corporation, Tokyo (JP)

( * ) Notice: Subject to any disclaimer, the term of this patent is extended or adjusted under 35 U.S.C. 154(b) by 442 days.

(21) Appl. No.: 12/615,189

(22) Filed: Nov. 9, 2009

(65) Prior Publication Data

US 2010/0172684 A1 Jul. 8, 2010

(30) Foreign Application Priority Data

Nov. 10, 2008 (JP) ..... 2008-287302

(51) Int. Cl.
*B65H 5/08* (2006.01)

(52) U.S. Cl. ..... 271/10.12; 271/227; 271/171

(58) Field of Classification Search ..... 271/10.12, 271/227, 171

See application file for complete search history.

(56) References Cited

U.S. PATENT DOCUMENTS

2007/0040326 A1* 2/2007 Noda et al. ..... 271/227
2008/0237975 A1* 10/2008 de Jong et al. ..... 271/228

FOREIGN PATENT DOCUMENTS

JP 2002-128286 A 5/2002

* cited by examiner

*Primary Examiner* — David H Bollinger
(74) *Attorney, Agent, or Firm* — Kilpatrick Townsend & Stockton LLP

(57) ABSTRACT

A paper feeding device for feeding a sheet of printing paper to a printing position of a printing apparatus in order to print the paper is disclosed. The paper feeding device includes a paper tray that stores plural sheets of the paper, a transport unit that transports the paper from the paper tray to the printing position, a guide unit that is provided to adjust a guide width in accordance with the width of the paper which is substantially perpendicular to a feeding direction of the paper transported by the transport unit, and to guide the paper which is transported from the paper tray by the transport unit.

4 Claims, 7 Drawing Sheets

FIG. 6

| PAPER CLASSIFICATION | SKEW REMOVAL PERFORMING EDGE GUIDE POSITION PEP |
|---|---|
| L | a1 |
| A5 | b1 |
| A4 | c1 |
| B5 | d1 |
| B4 | e1 |
| A3 | f1 |
| L (THICKNESS) | g1 |
| A5 (THICKNESS) | h1 |
| ⋮ | ⋮ |

PAPER FEEDING DEVICE AND PROGRAM FOR CONTROLLING THE SAME

This application claims priority to Japanese Patent Application No. 2008-287302, filed Nov. 10, 2008, the entirety of which is incorporated by reference herein.

BACKGROUND

1. Technical Field

The present invention relates to a paper feeding device for feeding a sheet of printing paper to a printing position of a printing apparatus in order to print the paper, and a program for controlling the paper feeding device.

2. Related Art

In a paper feeding device for feeding a sheet of paper to a printing position of a printing apparatus in order to print the paper, it is known that the so-called skew (a slope of the paper) occurs in the transported paper due to the structure of the device. The paper feeding device disclosed in JP-A-2002-128286 (see paragraphs 0010 and 0034, FIG. 1, and so forth) includes a paper tray provided with a stationary edge guide and a movable edge guide for guiding the paper to be transported. The movable edge guide is integrally formed with a movable edge side hopper for pushing up the paper towards a paper feeding roller, and a movable edge side cam mechanism for driving the movable edge side hopper. With this configuration, if the movable edge guide is moved in line with a width of the paper, the movable edge side hopper and the movable edge side cam mechanism are also moved in line with the width of the paper. As a result, since the movable edge side hopper for pushing up the paper towards the paper feeding roller and the movable edge side cam mechanism move together in line with the width of the paper, the movable edge side hopper and the movable edge side cam mechanism are always structurally disposed at a position adjacent to each other, regardless of the paper size. Therefore, components for transmitting a driving force from the movable edge side cam mechanism to the movable edge side hopper are not twisted, and the movable edge side cam mechanism can properly drive the movable edge side hopper. Consequently, balance between the pushing-up of the paper by the movable edge side hopper driven in the movable edge side cam mechanism and the pushing-up of the paper by the stationary edge side hopper driven in a stationary edge side cam mechanism fixedly disposed is maintained, so that a transport load is not applied to one side of the paper by pushing up both ends thereof towards the paper feeding roller by the use of both hoppers, thereby preventing occurrence of failure such as skew.

Such a paper feeding device takes account of the skew of the paper which is caused by the structure of the device or the like. However, no regard is paid to the skew of the paper which is caused by a phenomenon which is unrelated to the structure of the device itself, for example, use environment of the printing apparatus, such as an installation place of the printing apparatus, after shipping of the device, a user's habit of adjusting the guide width of the edge guide, which is provided on the paper tray, voluntarily to feed the paper, or the like. Therefore, there is much room for improvement.

SUMMARY

An advantage of some aspects of the invention is that it provides a technique capable of settling a skew of paper which is caused by user's habit or the like.

An aspect of the invention is to provide a paper feeding device for feeding a sheet of printing paper to a printing position of a printing apparatus in order to print the paper, the paper feeding device including: a paper tray that stores plural sheets of the paper; a transport unit that transports the paper from the paper tray to the printing position; a guide unit that is provided to adjust a guide width in accordance with the width of the paper which is substantially perpendicular to a feeding direction of the paper transported by the transport unit, and to guide the paper which is transported from the paper tray by the transport unit; a guide width detecting unit that detects the guide width; a slope deriving unit that derives a slope of the paper to the feeding direction of the paper when the paper is printed; a skew removal unit that performs skew removal to cancel the slope of the paper before the paper is transported to the printing position by the transport unit; a guide width-slope relation deriving unit that derives a guide width-slope relation to estimate a slope estimation value of the paper in the guide width, based on the guide width detected by the guide width detecting unit and the slope of the paper derived by the slope deriving unit; a memory unit that stores the guide width-slope relation derived by the guide width-slope relation deriving unit; a judgment unit that obtains the slope estimation value in a current guide width detected by the guide width detecting unit from the guide width-slope relation, when a subsequent sheet of paper is printed, and judges whether or not the skew removal is to be performed by the skew removal unit; and a control unit that controls the skew removal unit to perform the skew removal, when the judgment unit judges that the skew removal has to be performed.

Another aspect of the invention is to provide a program for controlling a paper feeding device which feeds a printing paper to a printing position of a printing apparatus in order to print the paper, in which the paper feeding device includes a paper tray that stores plural sheets of the printing paper; a transport unit that transports the paper from the paper tray to the printing position; a guide unit that is provided to adjust a guide width in accordance with the width of the paper which is substantially perpendicular to a feeding direction of the paper transported by the transport unit, and to guide the paper which is transported from the paper tray by the transport unit; a guide width detecting unit that detects the guide width; a slope deriving unit that derives a slope of the paper to the feeding direction of the paper when the paper is printed; and a skew removal unit that performs skew removal to cancel the slope of the paper before the paper is transported to the printing position by the transport unit, wherein the program performs: a function, as a guide width-slope relation deriving unit, for deriving a guide width-slope relation to estimate a slope estimation value of the paper in the guide width, based on the guide width detected by the guide width detecting unit and the slope of the paper derived by the slope deriving unit; a function for storing the guide width-slope relation derived by the guide width-slope relation deriving unit in a memory unit; a function, as a judgment unit, for obtaining the slope estimation value in a current guide width detected by the guide width detecting unit from the guide width-slope relation, when a subsequent sheet of paper is printed, and judging whether or not the skew removal is to be performed by the skew removal unit; and a function, as a control unit, for controlling the skew removal unit to perform the skew removal, when the judgment unit judges that the skew removal has to be performed.

With the invention with such a configuration, the guide width-slope relation deriving unit derives the guide width-slope relation to predict the slope estimation value of the paper to the guide width, on the basis of the guide width obtained by the guide width detecting unit and the slope of the paper derived by the slope deriving unit. And, when the subsequent sheet of paper is printed, since the slope estimation value of the paper in the current guide width detected by the guide width detecting unit is obtained from the guide width-slope relation stored in the memory unit, and the judgment unit judges whether the skew removal is performed by the skew removal unit. The skew may occur in the paper transported by the transport unit due to a phenomenon which is unrelated to the structure of the paper feeding device, for example, use environment of the paper feeding device after shipping, a user's habit of adjusting the guide width of the guide unit voluntarily to feed the paper, or the like. However, according to the above configuration, when the subsequent sheet of paper is printed, since the skew removal performing control unit controls the skew removal unit to perform the skew removal by the judgment unit judging that the skew removal should be performed, the skew of the paper which is caused by the user's habit or the like can be settled.

In this instance, it is preferable that the paper feeding device further includes an update unit that updates the guide width-slope relation stored in the memory unit based on the guide width-slope relation derived by the guide width-slope relation deriving unit, whenever the paper is printed.

With such a configuration, the update unit updates the guide width-slope relation stored in the memory unit on the basis of the newly derived guide width-slope relation, whenever the paper is printed. Therefore, even though the use circumference of the paper feeding device is changed or the guide width of the guide unit is readjusted by the user, the judgment unit always judges whether or not the skew removal is to be performed on the basis of the new guide width-slope relation, so that the skew in the paper caused by the user's habit or the like can be reliably settled.

In addition, it is preferable that the paper feeding device further includes a threshold value determining unit that determines the threshold value of the guide width which is a reference to judge whether or not the skew removal is to be performed, based on the slope estimation value of the paper which is obtained from the guide width-slope relation, and that the judgment unit judges whether or not the skew removal is to be performed by the skew removal unit, based on the guide width detected by the guide width detecting unit and the threshold value determined by the threshold value determining unit, when the paper is printed.

With such a configuration, when the paper is printed, the judgment unit judges whether or not the skew removal is to be performed, on the basis of the threshold value of the guide width which is determined by the threshold value determining unit based on the guide width detected by the guide width detecting unit and the slope estimation value of the paper obtained from the guide width-slope relation, the threshold value being a reference to judge whether or not the skew removal is to be performed. Therefore, the judgment unit judges whether or not the skew removal is to be performed, simply by comparing the current guide width with the threshold value, so that it can try to simplify the processing.

In addition, the memory unit stores the guide width-slope relation for at least each paper size of the paper. The judgment unit can judge whether or not the skew removal is to be performed, on the basis of the guide width-slope relation which corresponds to the paper size of the paper, and can perform the judgment accurately. Therefore, it is of practical use.

BRIEF DESCRIPTION OF THE DRAWINGS

The invention will be described with reference to the accompanying drawings, wherein like numbers reference like elements.

FIG. 6 is a view illustrating an example of a threshold value to determine whether or not skew removal is to be executed.

DESCRIPTION OF EXEMPLARY EMBODIMENTS

Figure 1:
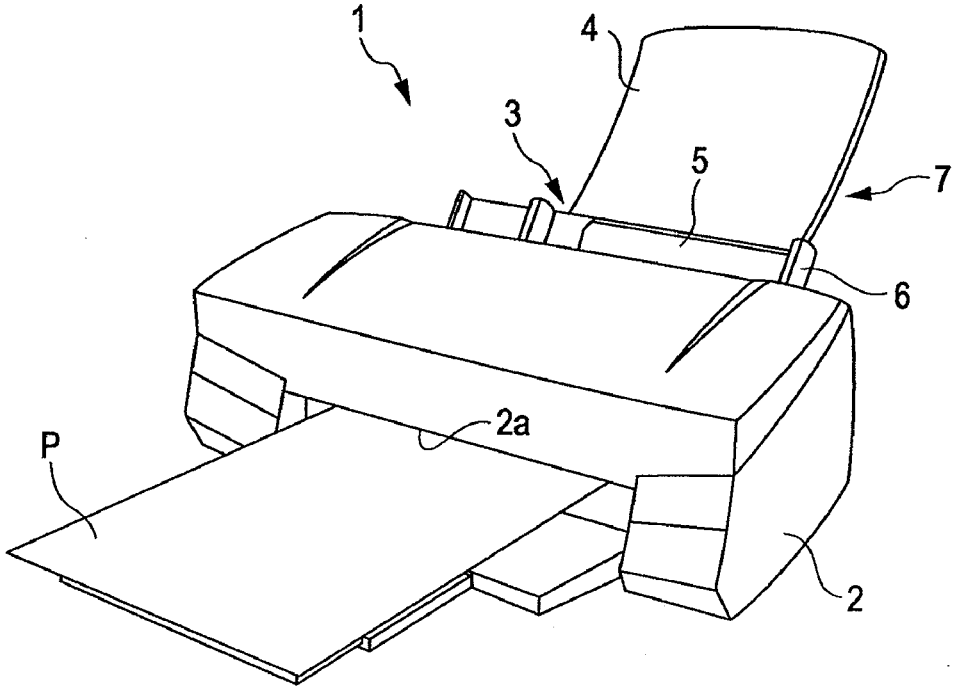
FIG. 1 is a perspective view illustrating an ink jet printer including a paper feeding device according to the invention.
Figure 2:
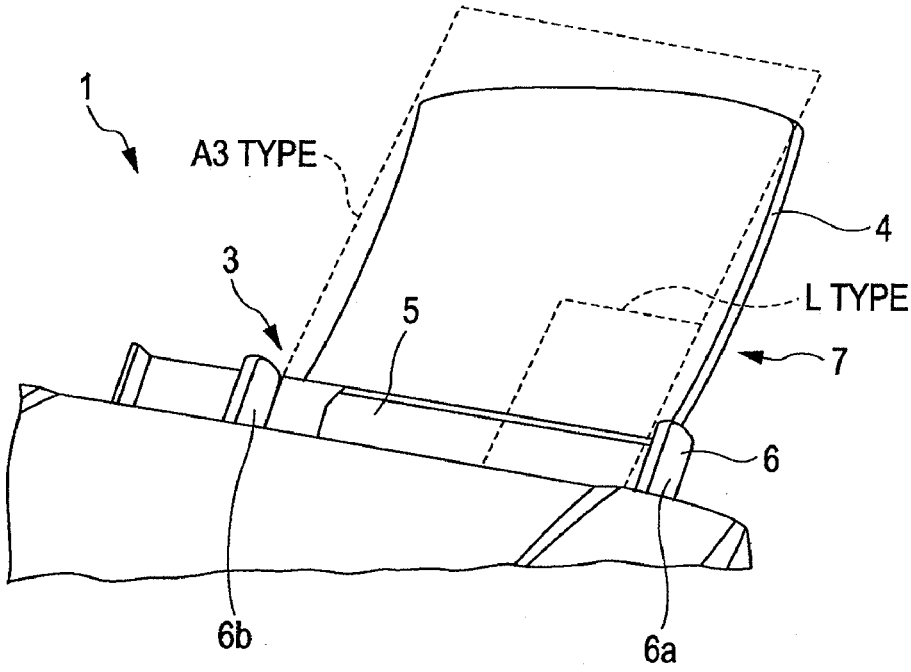
FIG. 2 is an enlarged view illustrating a major part of the ink jet printer.
Figure 3:
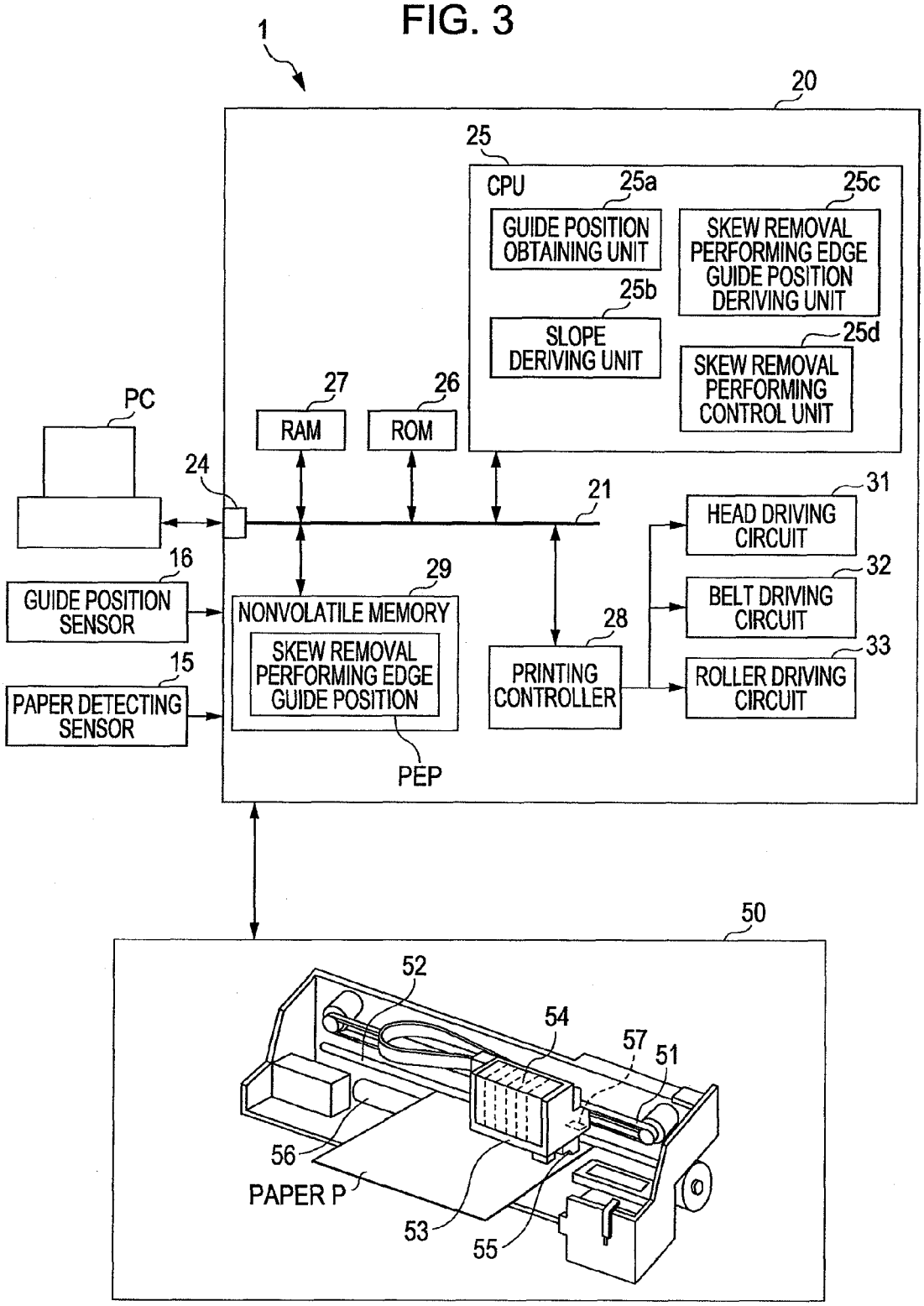
FIG. 3 is a view schematically illustrating the internal configuration of the ink jet printer.
Figure 4:
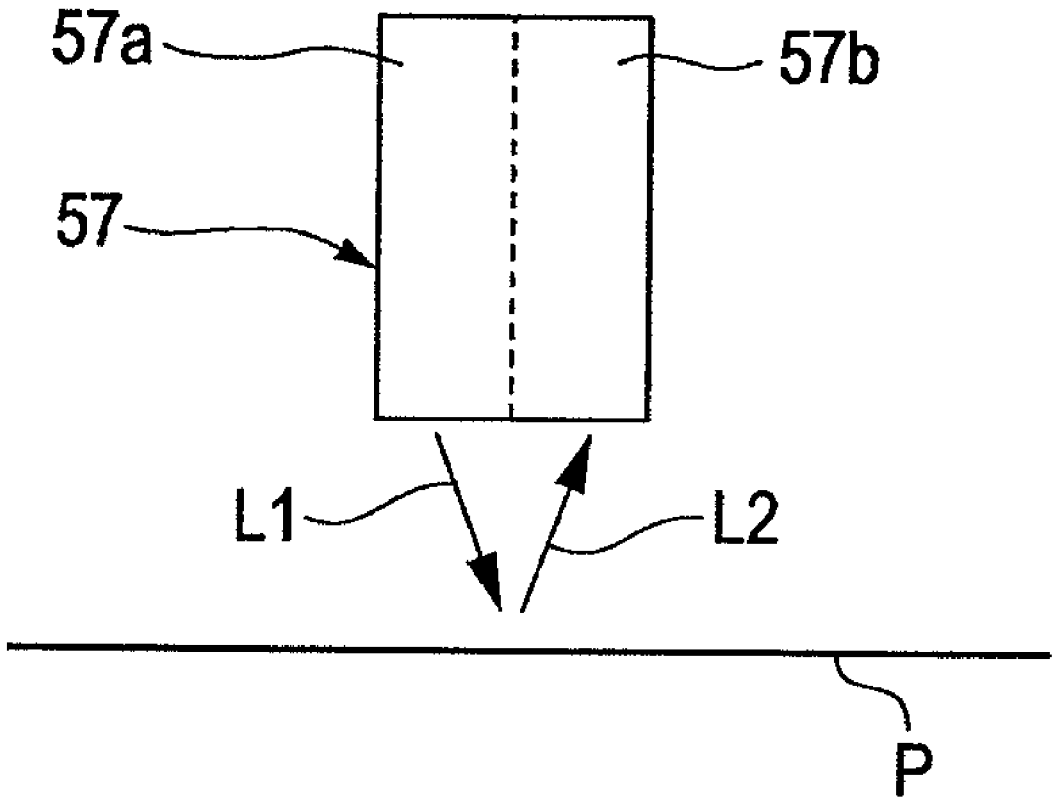
FIG. 4 is a view illustrating the configuration of a paper trailing-end detecting sensor.
Figure 5A:
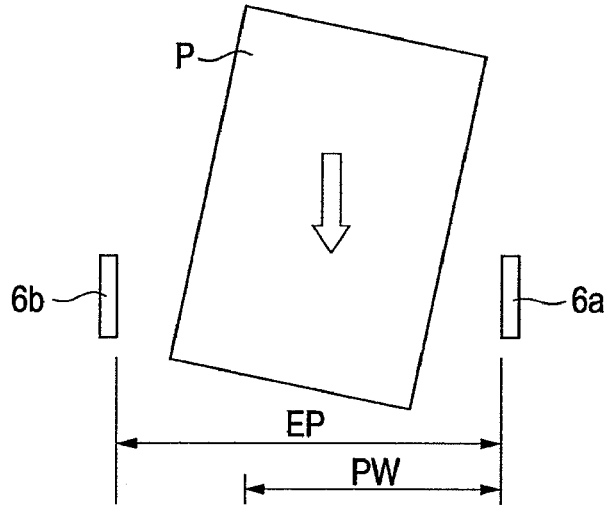
FIGS. 5A to 5C are views illustrating a paper transport state.
Figure 7A:
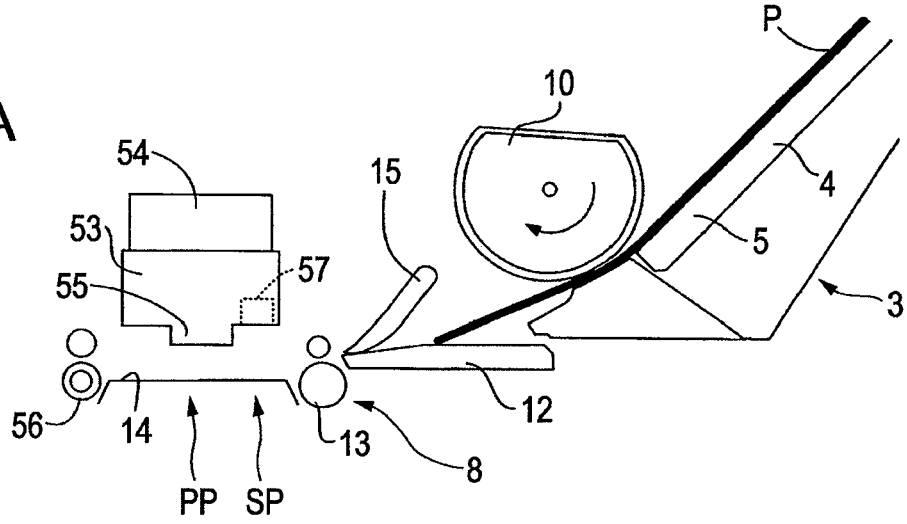
FIGS. 7A to 7C are views illustrating the operation of the skew removal.
Figure 7B:
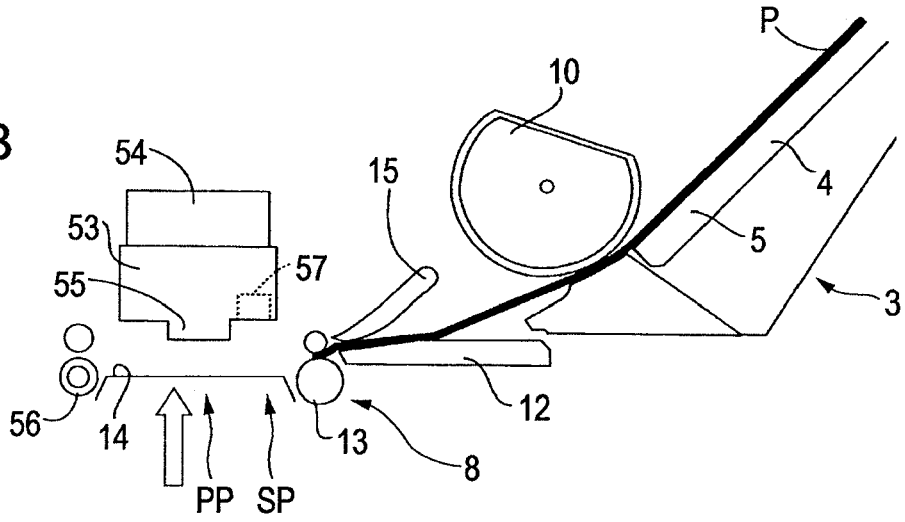
Figure 7C:
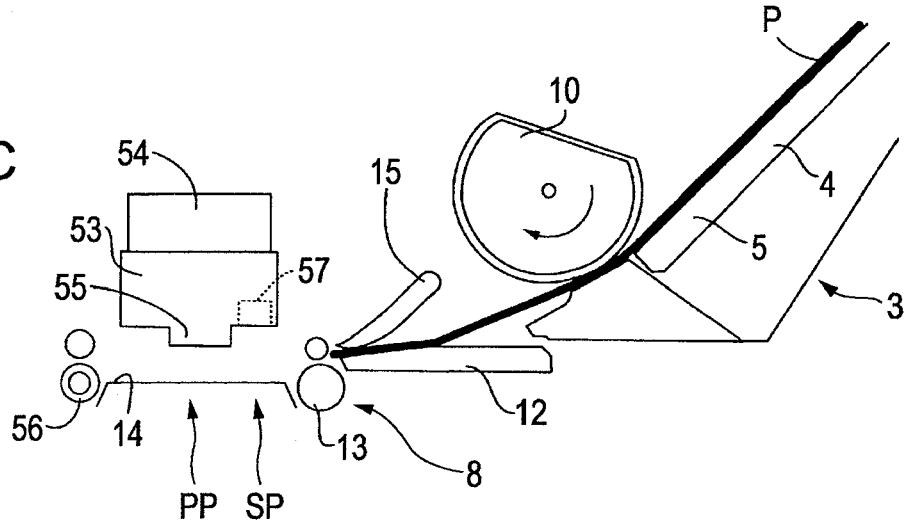

FIG. 1 is a perspective view illustrating an ink jet printer 1 including a paper feeding device according to the invention. FIG. 2 is an enlarged view illustrating a major part of the ink jet printer 1. FIG. 3 is a view schematically illustrating the internal configuration of the ink jet printer 1. FIG. 4 is a view illustrating the configuration of a paper trailing-end detecting sensor 57. FIG. 5 is a view illustrating a transport state of a paper P. FIG. 6 is a view illustrating an example of a threshold value to determine whether or not skew removal is to be executed, and shows a state where a nonvolatile memory 29 is stored with a skew removal executing edge guide position PEP for each paper size of the paper P as a threshold value, which is described below, according to the invention. FIG. 7 is a view illustrating the operation of the skew removal, in which FIG. 7A is a view illustrating a state where the paper P is starting to transport from a paper tray 4 to a printing position PP of the ink jet printer 1 by an auto sheet feeder 3 to print the paper P, FIG. 7B is a view illustrating a state where the leading end of the paper P is bitten by a paper feeding roller 13, and FIG. 7C is a view illustrating a state where the leading end of the paper P bitten by the paper feeding roller 13 is discharged from a transport roller 56. In the ink jet printer 1 as a printing apparatus of the invention, meanwhile, a printer body 2 is equipped with a printing mechanism 50 (see FIG. 3) therein thereby to perform the printing of the paper P in accordance with a motion command from a controller 20 (see FIG. 3) that serves to control the whole of the ink jet printer 1. The paper P printed in this manner is transported to the front side of the printer body 2.

The printer body 2 is provided at the rear side thereof with the auto sheet feeder 3 which corresponds to a paper feeding device. The auto sheet feeder 3 is provided with a paper guide 7 having a paper tray 4 for carrying plural sheets of the paper P, a displacement plate 5, and an edge guide 6. The edge guide 6 includes a stationary edge guide 6*a* and a movable edge guide 6*b* which is controlled by the auto sheet feeder 3 in the width direction substantially perpendicular to a feeding direction of the paper P. The printer body 2 is adapted to adjust a guide width, that is, an edge guide position EP of the movable edge guide 6*b*, in accordance with a width of the paper P, thereby guiding the paper P to be transported from the paper tray by the auto sheet feeder 3. As shown in FIG. 2, the guide width is adjusted by performing the position adjustment of the movable edge guide 6*b* of the edge guide 6 provided in the paper guide 7, and the paper tray 4 is adapted to carry plural sheets of the paper P with various sizes ranging from L-type size to A3 size. Also, the ink jet printer 1 is provided with a guide position sensor 16 including a desired sensor, such as linear sensor or rotation potentiometer, and detecting the edge guide position EP of the movable edge guide 6*b* to measure the guide width. The guide position sensor 16 outputs the detected edge guide position EP to the controller 20.

Also, the auto sheet feeder 3 includes a transport mechanism 8 (corresponding to a transport unit according to the invention) for feeding plural sheets of the printing paper P which are stacked on the paper tray 4, to the position of the print head 55 in the printer body 2 at the printing position PP along the paper guide 7 one by one (see FIG. 7). The transport mechanism 8 is adapted to be controlled by a control command from the print controller 28 described below to transport the paper P by a desired feed amount for each paper feed control step outputted from the printing controller 28. Furthermore, as hereinafter described in detail with reference to FIG. 3, the printer body 2 is provided therein with a carriage 53 reciprocated in a width direction (main scanning direction) substantially perpendicular to a feeding direction (sub scanning direction) of the paper P which is transported from an upstream side to a downstream side by the transport mechanism 8. A printing head 55 is installed under the carriage 53, and is reciprocated together with the carriage 53, so that ink is ejected from the printing head 55 at a desired timing to perform the printing of the paper P at the printing position PP. Then, the printed paper P is discharged from a discharge port 2*a* opened at the front lower portion of the printer body 2.

Next, the printing mechanism 50 for performing the printing of the paper P fed from the paper tray 4 will now be described with reference to FIGS. 3 to 6. In the printing mechanism 50, as shown in FIG. 3, the carriage 53 is driven by a timing belt 51 bridged from side to side in a loop type, and is reciprocated along a guide 52 in right and left directions (main scanning direction). The carriage 53 is provided with a paper end detecting sensor 57 to detect the left and right ends or the upper and lower ends of the paper P. That is, the paper end detecting sensor 57 can recognize the paper width PW by detecting the left and right ends of the paper P, when the carriage 53 scans the paper P fed from the paper tray 4 in the paper end detecting position SP prior to printing, or can recognize a length PL of the paper P by detecting a state where the leading and trailing ends of the paper P transported from the upstream side to the downstream side by the transport mechanism 8 pass through the paper end detecting position SP (see FIG. 5).

As shown in FIG. 4, the paper end detecting sensor 57 includes a light emitting portion 57*a* constituted of a light emitting diode and the like, and a light receiving portion 57*b* constituted of a light receiving sensor, such as a photo transistor, and the like, and receiving a reflected light L2 generated by irradiation of the light L1 from the light emitting portion 57*a* to the paper P. In other words, the light L1 irradiated from the light emitting portion 57*a* is reflected by the paper P, and the reflected light L2 is received by the light receiving portion 57*b* and is converted into an electrical signal. The paper end detecting sensor measures the magnitude of the electrical signal as an output value of the light receiving sensor which corresponds to the intensity of the reflected light L2 received by the light receiving portion.

Also, the paper end detecting sensor 57 converts the electrical signal which corresponds to the intensity of the received light, into an 8-bit digital value (the maximum value of the intensity of the received light is 0, while the minimum value of the intensity of the received light is 255) through A/D conversion (analog to digital conversion), and outputs the digital value to the controller 20. That is, in the case of a "paper absent" state in the paper end detecting position SP, as amount of the reflected light is decreased and the amount of the received light is then decreased, the sensor output (A/D value) approximates 255. In the case of a "paper present" state in the paper end detecting position SP, as the amount of the reflected light is increased and the amount of the received light is then increased, the sensor output (A/D value) approximates 0. In this embodiment, the sensor output in the state where the paper is absent in the paper end detecting position SP is referred to as a sensor output "paper absent", while the sensor output in the state where the paper is present in the paper end detecting position SP is referred to as a sensor output "paper present".

A CPU 25 of the controller 20 sets an ink ejecting area on the paper P in a subsidiary scanning direction and a main scanning direction of the printing head 55, in which the position of the subsidiary scanning direction (the feeding direction of the paper P) or the main scanning direction (a direction substantially perpendicular to the subsidiary scanning direction) is set as a leading end (a paper end) of the paper P when the sensor output outputted from the paper end detecting sensor 57 is a threshold value described below. And then, the CPU 25 performs the printing of the paper P.

The measurement sensitivity of the paper end detecting sensor 57 for the amount of the received light (amount of the reflected light) is gradually decreased due to the age degradation of the paper end detecting sensor 57 itself, the adhesion of mist, which is generated when the ink is ejected from the printing head 55, onto the light receiving portion 57*b* of the paper end detecting sensor 57, or the like. As a result, it causes the detection accuracy of paper end detecting sensor 57 with respect to the end position of the paper P to decrease. In this embodiment, whenever the paper P is printed, the paper end detecting sensor 57 is adapted to detect the sensor output "paper absent" and the sensor output "paper present", and to set an intermediate value of both sensor outputs as a threshold value when the end of the paper P is detected. With the above configuration, the paper end detecting sensor 57 can always detect the end position of the paper P with high precision, even if the measurement sensitivity of the paper end detecting sensor 57 for the amount of the received light is varied.

In this embodiment, although the reflective paper end detecting sensor 57 is integrally constituted of the light emitting portion 57*a* and the light receiving portion 57*b*, as shown in FIG. 4, the light emitting portion and the light receiving portion may be separately provided. Also, the paper end detecting sensor may be constituted as a photo-interrupter, in which the light emitting portion and the light receiving portion are disposed in such a way to be opposite to each other, and the light receiving portion directly receives the light from the light emitting portion. With the above configuration, the paper P is interposed between the light emitting portion and the light receiving portion which are provided in a predetermined paper end detecting position, and the end of the paper P positioned in the predetermined paper end detecting position is detected by interrupting the light irradiated from the light emitting portion to the light receiving portion.

Also, the carriage 53 is equipped with ink cartridges 54 which are respectively filled with ink of various colors, such as cyan, magenta, yellow, black, and so forth. The ink cartridges 54 are respectively connected to the printing head 55. The printing head 55 applies pressure to the ink cartridges 54 to eject the ink from a nozzle (not shown) towards the paper P. In this embodiment, the printing head 55 employs a configuration in which the ink is pressed by the deformation of a piezoelectric device that is caused by application of a voltage, but the printing head may employ a configuration in which the ink is pressed by bubbles generated from the ink heated by applying a voltage to a heating resistor (e.g., a heater). The printed paper P is fed to the discharge port 2*a* by the transport roller 56.

The configuration of the controller 20 provided in the ink jet printer 1 will now be described with reference to FIG. 3. As shown in FIG. 3, the ink jet printer 1 according to the embodiment is adapted to be communicatively connected to a host computer PC via an interface 24 constituted of a USB interface, a parallel interface, or the like. The host computer PC executes the conversion of image data or document data into printing data by the use of a printer driver including a program and a CPU. The printing data and printing command are sent to the ink jet printer 1 from the host computer PC.

A system bus 21 of the controller 20 which is connected to the interface 24 is connected to a CPU 25, a ROM 26, a RAM 27, a printing controller 28 (corresponding to a skew removal unit of the invention), a nonvolatile memory 29 (corresponding to a memory unit of the invention), and so forth. The CPU 25 performs, for example, arithmetic processing to control operation of the printing mechanism 50. In addition, the CPU 25 executes the program stored in the ROM 26, and is adapted to output commands required for the printing control to the printing controller 28, commands to feed and discharge the paper P, and a command to execute the skew removal described hereinafter, to the printing controller 28. The ROM 26 is stored with, for example, a program (firmware) required for controlling the CPU 25. The RAM 27 is temporarily stored with data such as print data inputted from the outside, and the nonvolatile memory 29 is stored with diverse data or tables required for controlling the CPU 25. As shown in FIG. 6, in this embodiment, the nonvolatile memory 29 is stored with a skew removal performing edge guide position PEP for each paper size of the paper P, on the basis of a slope estimation value of the paper P which is obtained from a guide width-slope relation described below, the skew removal performing edge guide position PEP, which is a threshold value of the edge guide position EP indicative of the guide width, being a reference to judge whether or not the skew removal is to be performed to cancel the slope SL of the paper P. In this embodiment, the skew removal means the processing of settling the skew (the slope SL of the paper P) occurring at the paper P transported by the transport mechanism 8, due to the structure of the auto sheet feeder 3 or several phenomena, such as the use environment of the ink jet printer 1, a user's habit of adjusting the guide width of the edge guide 6 voluntarily to feed the paper P, or the like. This embodiment is adapted to perform skew removal of the known biting and ejecting type.

Also, the printing controller 28 is connected to a head driving circuit 31, a belt driving circuit 32, and a roller driving circuit 33. The printing controller 28 controls the printing head 55 by the use of the head driving circuit 31 to eject the ink onto the paper P, controls a carriage motor (not shown) by the use of the belt driving circuit 32 to perform the reciprocating movement of the carriage 53, and controls a paper feeding motor (not shown) by the use of the roller driving circuit 33 to rotate the transport roller 56, the paper feeding roller 13 and a loading roller 10 (see FIG. 7) respectively at a given timing. In this embodiment, at least information on the paper size of the paper P is contained in the printing command to instruct the printer to print the paper P, so that the printing controller 28, and controls the transport mechanism 8 to transport the paper P in accordance with the printing command.

The printing controller 28 interprets a command of the printing data inputted from the host computer PC, and performs the data sequence. The printing controller is adapted to control the printing head 55 by the head driving circuit 31 on the basis of the data and so forth. Therefore, the printing controller 28 drives the printing mechanism 50 to perform the printing control, and performs the feeding and discharging process of the paper P on the basis of the printing command from the CPU 25.

As shown in FIG. 3, the CPU 25 is adapted to perform a function as the respective units which is described below, by executing the program stored in the ROM 26.

A guide position obtaining unit 25*a* (corresponding to a guide width detecting unit of the invention) obtains the edge guide position EP as the guide width, on the basis of the detection result of the edge guide position EP detected by the guide position sensor 16, and temporarily stores the edge guide position EP in the RAM 27.

Figure 5B:
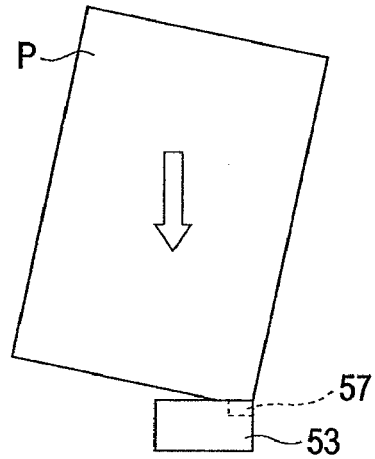
Figure 5C:
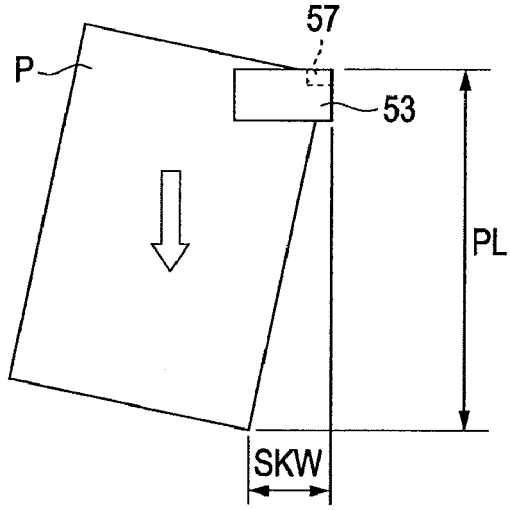

A slope deriving unit 25*b* derives the slope SL with respect to the feeding direction of the paper P transported by the transport mechanism 8 when the paper P is printed. In other words, as shown in FIG. 5B, when the paper P is printed, the leading end of one side of the paper P is first detected by the paper end detecting sensor 57. Then, as shown in FIG. 5C, the slope SL of the paper P is derived from a misalignment amount SKW which is derived by detecting the rear end of one side of the paper P, and a length PL of the paper P, based on the operation of the following equation:

$$SL(\text{slope of paper})=\arctan(SKW/PL)$$

The derived slope SL of the paper is temporarily stored in the RAM 27. As described above, the slope deriving unit of the invention is constituted of the slope deriving unit 25*b* and the paper end detecting sensor 57.

A skew removal performing edge guide position deriving unit 25*c* (corresponding to a guide width-slope relation deriving unit, a threshold value determining unit, and an update unit of present invention) derives a guide width-slope relation to predict a slope estimation value of the paper with respect to the edge guide position EP detected by the guide position obtaining unit 25*a*, from the edge guide position (guide width) EP obtained by the guide position obtaining unit 25*a* and stored in the RAM 27 and the slope SL of the paper P derived by the slope deriving unit 25*b* and stored in the RAM 27. The guide width-slope relation derived by the skew removal performing edge guide position deriving unit 25*c* is stored in the nonvolatile memory 29 (not shown).

In this embodiment, the skew removal performing edge guide position deriving unit 25*c* is adapted to determine the skew removal performing edge guide position PEP which is a threshold value of the edge guide position EP, on the basis of the slope estimation value of the paper P obtained from the derived guide width-slope relation, the edge guide position EP being a reference to judge whether or not the skew removal is to be performed. The skew removal performing edge guide position PEP determined by the skew removal performing edge guide position deriving unit 25*c* is stored in the nonvolatile memory 29 (see FIGS. 3 and 6). For example, it is preferable that the edge guide position EP, in which the magnitude of the slope estimation value of the slope SL of the paper P that is estimated from the derived guide width-slope relation is larger than 1°, is set as the skew removal performing edge guide position PEP.

In addition, the skew removal performing edge guide position deriving unit 25*c* may be adapted to derive the guide width-slope relation whenever the paper P is printed, and update the guide width-slope relation stored in the nonvolatile memory 29 on the basis of the newly derived guide width-slope relation. With the above configuration, the information on the guide width-slope relation derived by the skew removal performing edge guide position deriving unit 25*c* may be accumulated in the nonvolatile memory 29 for each printing. Accordingly, by a learning effect achieved by updating the guide width-slope relation previously derived and stored in the nonvolatile memory 29 on the basis of the stored previous guide width-slope relation and the guide width-slope relation newly derived for each printing, it is possible to store the guide width-slope relation with higher precision in the nonvolatile memory 29 for each printing.

A skew removal performing control unit 25*d* (corresponding to a judgment unit and a control unit of the invention) obtains the slope estimation value of the paper P in the current guide position EP which is obtained from the guide width-slope relation stored in the nonvolatile memory 29 by the guide position obtaining unit 25*a* when the paper P is printed, and judges whether or not the skew removal is to be performed. In this embodiment, when the paper P is printed, the skew removal performing control unit 25*d* is adapted to judge whether or not the skew removal is to be performed, on the basis of the current guide position EP obtained by the guide position obtaining unit 25*a* and the skew removal performing edge guide position PEP stored in the nonvolatile memory 29.

Therefore, the skew removal performing control unit 25*d* judges whether or not the skew removal is to be performed, by using the skew removal performing edge guide position PEP stored in the nonvolatile memory 29. Only the skew removal performing edge guide position PEP may be stored in the nonvolatile memory 29 as the guide width-slope relation. In this instance, the skew removal performing edge guide position deriving unit 25*c* may compare the edge guide position EP with the derived slope SL of the paper P, whenever the paper is printed, and store the edge guide position EP, for example, in which the magnitude of the slope SL is larger than 1°, in the nonvolatile memory 29 as the skew removal performing edge guide position PEP.

If it is judged that the skew removal should be performed as a result of the above judgment, the skew removal performing control unit 25*d* is adapted to output a control command to the printing controller 28 to perform the skew removal. Notwithstanding the skew removal performing edge guide position PEP as the threshold value, the skew removal performing control unit 25*d* may judge whether or not the skew removal is to be performed, on the basis of the guide width-slope relation stored in the nonvolatile memory 29, for example, the information indicative of correlation between the guide width EP and the slope SL of the paper P.

Next, the configuration and operation of the auto sheet feeder 3 and the skew removal will now be described with reference to FIGS. 5 and 7. As shown in FIG. 7, the auto sheet feeder 3 includes the loading roller 10 disposed opposite to the displacement plate 5 in the vicinity of the lower end of the displacement plate 5 which is located at the rear side of the printer body 2, the paper feeding roller 13, and the transport mechanism 8 (corresponding to a skew removal unit of the invention) having a transport roller 56. The auto sheet feeder 3 is provided with a guide 12 at the downstream side of the loading roller 10 in the paper feeding direction. As shown in FIG. 7A, the loading roller 10 comes in contact with one sheet of the uppermost paper among plural sheets of the papers P stacked on the paper tray 4 and the displacement plate 5 in a circular arc surface, and rotates in the direction of an arrow in FIG. 7A, so that the paper P is fed to the paper feeding roller 13. In the embodiment shown in FIG. 7, although the case in which only one sheet of the paper P is stored in the paper tray 4 is described in order to conveniently explain the paper feeding operation of the printing paper P, it goes without saying that plural sheets of the paper P may be stored in the paper tray 4.

As described above, the loading roller 10, the paper feeding roller 13 and the transport roller 56 are adapted to be rotated by a paper feeding motor (not shown) which is driven by the roller driving circuit 33 (corresponding to the skew removal unit of the invention) on the basis of the control step from the printing controller 28. Also, the loading roller 10 and the paper feeding motor are connected to each other via a clutch which is switched between disconnection and connection to power transmission. Accordingly, the clutch is switched to the connection state when the paper P is fed from the paper tray 4 to the paper feeding roller 13, so that the loading roller 10 is driven by the clutch.

In addition, in this embodiment, the paper feeding motor generates a driving force in a rotation direction in response to a driving amount outputted from the roller driving circuit 33 on the basis of the control step from the printing controller 28. The paper feeding motor rotates the paper feeding roller 13 and the transport roller 56 by using the driving force. That is, if the paper feeding motor generates a predetermined driving amount, the paper feeding roller 13 and the transport roller 56 are rotated at the predetermined rotating amount. If the paper feeding roller 13 and the transport roller 56 are rotated at the predetermined rotating amount, the paper P is transported by a predetermined feeding amount.

Accordingly, the feeding amount of the paper P is determined in accordance with the rotating amount of the paper feeding roller 13 and the transport roller 56. In this embodiment, for example, if the paper feeding roller 13 and the transport roller 56 are rotated one revolution, the paper is transported by 1 inch. In other words, the paper feeding roller 13 and the transport roller 56 have a circumference length of 1 inch. For this reason, if the paper feeding roller 13 and the transport roller 56 are rotated by a quarter of a revolution, the paper P is transported by a quarter of an inch. Therefore, if the rotating amount of the paper feeding roller 13 and the transport roller 56 is detected, the feeding amount of the paper P can be also detected. In order to detect the rotating amount of the paper feeding roller 13 and the transport roller 56, a rotary encoder (not shown) is provided.

The rotary encoder includes a scale with a plurality of slits provided thereon at a predetermined interval, and a detecting portion fixed to a side of the printer body 2 facing to the scale. The scale is provided on each of the paper feeding roller 13 and the transport roller 56, and if the paper feeding roller 13 and the transport roller 56 are rotated, the scale is rotated together with the rollers. If the transport roller 56 is rotated, the respective slits of the scale pass through the detecting portion in order. The rotary encoder is adapted to output a pulse signal whenever the slit provided on the scale passes through the detecting portion.

Consequently, as the slits provided on the scale pass through the detecting portion in order in accordance with the rotating amount of output of the paper feeding roller 13 and the transport roller 56, the rotating amount of the paper feeding roller 13 and the transport roller 56 can be detected on the basis of the rotary encoder. For example, when the paper P is transported by a feeding amount of 1 inch for each control step, the roller driving circuit 33 drives the paper feeding motor until the rotary encoder detects the fact that the paper feeding roller 13 or the transport roller 56 is rotated by one revolution. As seen from the above, until the rotary encoder detects the rotating amount of the paper feeding roller 13 or the transport roller 56 that corresponds to the predetermined feeding amount, the roller driving circuit 33 is adapted to transport the paper P from the upstream side to the downstream side by repeating the operation of driving the paper feeding motor and transporting the paper P on the basis of the number of control steps from the printing controller 28.

The paper feeding motor may be constituted of a stepping motor. With the above configuration, the printing controller 28 includes a counter as a counting member for counting the number of steps of the paper feeding motor, so that the printing controller 28 can detect the position of the paper P based on the counting value of the counter. When the feeding amount of the paper P is changed in accordance with the control step from the printing controller 28, a control command may be selected from a control map for controlling the stepping motor in such a way that the paper feeding motor is rotated in a rotation angle in line with the changed feeding amount.

The paper P is fed to the paper feeding roller 13 by the loading roller 10, and after the leading end of the paper P is detected by the paper detecting sensor 15 provided on the upstream side of the paper feeding roller 13, the loading roller 10 is further rotated by a predetermined amount, so that the leading end of the paper P is bitten by the paper feeding roller 13. Then, if the paper P is fed by the predetermined amount by the rotation of the paper feeding roller 13, the leading end of the paper P reaches the paper end detecting position SP, and the leading end of one side of the paper P is detected by the paper end detecting sensor 57 (see FIG. 5B). The paper P is further transported towards the downstream side, and the leading end of the paper P is positioned at the position which coincides with a reference position of the printing head 55 (indicated by an arrow in FIG. 7B). In other words, the paper P is fed from the paper tray 4 to a printing position PP between the carriage 53 and a platen 14 through the paper feeding rollers 13.

The printing for the paper P fed to the print mechanism 50 is completed, and when the paper P is discharged from the discharge port 2*a* by the transport roller 56, the paper end detecting sensor 57 detects the state where the trailing end of the paper P reaches the paper end detecting position SP, the trailing end of one side of the paper P is detected (see FIG. 5C). And, the paper P is further transported towards the downstream side, and when the predetermined amount of the paper P is discharged from the discharge port 2*a*, it starts to feed the subsequent sheet of paper P from the paper tray 4 to the printing position PP. In this embodiment, while the previous paper P is discharging from the discharge port 2*a*, when the leading end of the subsequent sheet of paper P is fed to the reference heading position, the previous paper P falls from the transport roller 56, and, at that time, it starts to feed the subsequent sheet of paper P to the printing position PP.

Next, the skew removal will be described with reference with FIG. 7. In this embodiment, before the paper P is transported to the printing position PP by the transport mechanism 8, the skew removal to cancel the slope SL of the paper P is performed according to the above conditions. The skew removal performed in this embodiment will now be described. If the skew removal performing control unit 25*d* judges that the skew removal should be performed, on the basis of the above conditions, and outputs a control command of performing the skew removal to the printing controller 28, the printing controller 28 controls the roller driving unit 33 to perform the skew removal on the basis of the control command.

As shown in FIG. 7B, the roller driving unit 33 feeds the paper P towards the downstream side by driving the loading roller 10, so that the paper is bitten by the paper feeding roller 13 in accordance with the control command of performing the skew removal outputted from the printing controller 28. Then, as shown in FIG. 7C, skew removal known as the biting and ejecting type is completed by reversing the paper feeding roller 13 to discharge the paper P towards the upstream side and again feeding the paper P to the paper feeding roller 13.

Although the configuration is adapted to perform the skew removal of the biting and ejecting type in this embodiment, the mode of skew removal is not limited thereto. If the slope SL of the paper P is canceled, any known mode of skew removal may be employed. Processing of the skew removal performing judgment will now be described with reference to FIG. 8.

Figure 8:
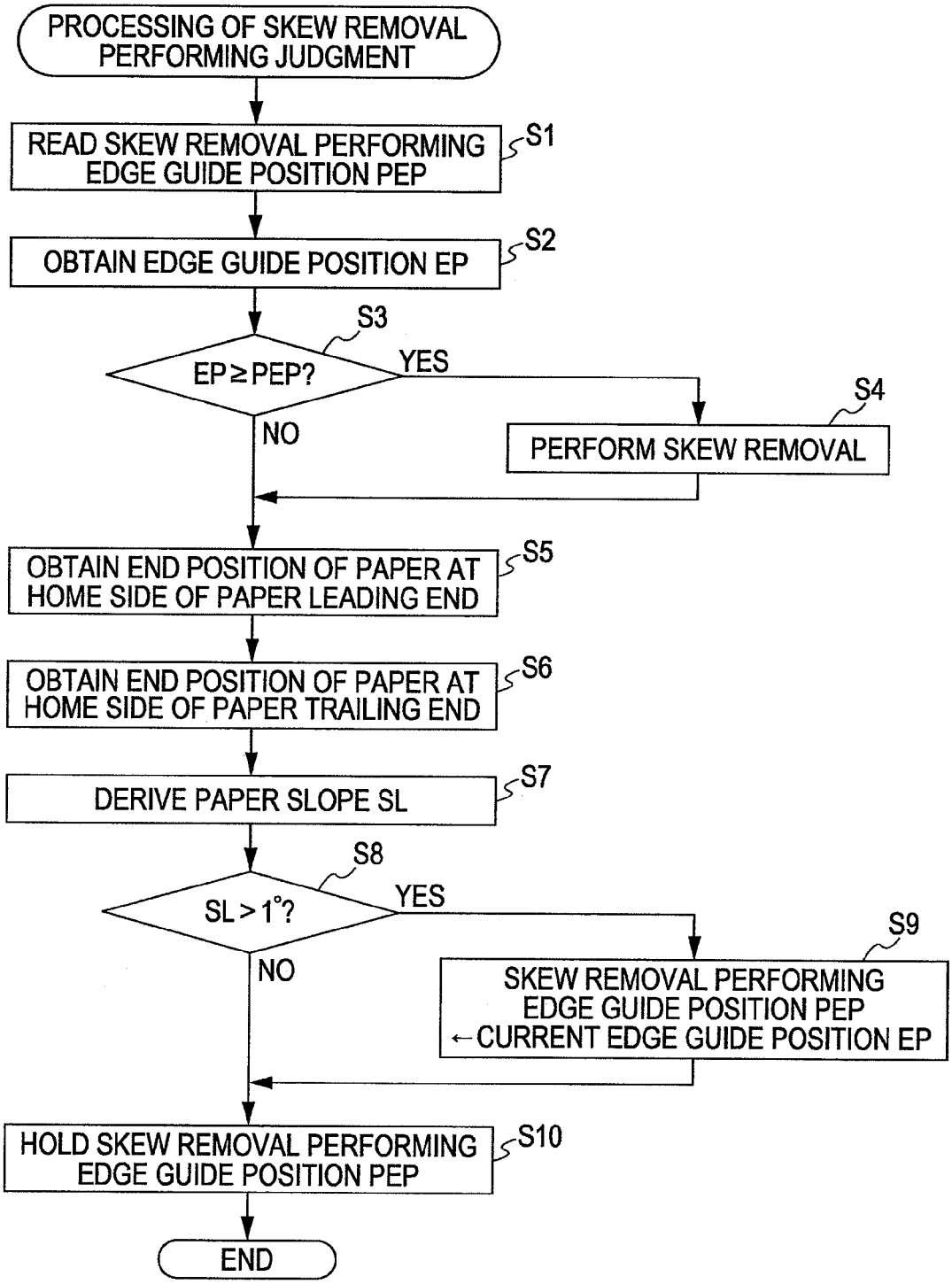
FIG. 8 is a flowchart illustrating a process of skew removal performing judgment.

FIG. 8 is a flowchart illustrating the processing of the skew removal performing judgment. The processing of the skew removal performing judgment shown in FIG. 8 is executed whenever the paper P is printed, and the judgment is performed by using the skew removal performing edge guide position PEP shown in FIG. 6. As shown in FIG. 8, if a printing command is issued from the host computer PC, the print processing is started by the printing controller 28, and transportation of the paper P is started. At the same time, the skew removal performing control unit 25*d* starts to read the skew removal performing edge guide position PEP from the nonvolatile memory 29 in response to the printing command, and acquires the current edge guide position EP obtained by the guide position obtaining unit 25*a* (steps S1 and S2). The skew removal performing control unit 25*d* judges whether the skew removal is performed, on the basis of the skew removal performing edge guide position PEP and the edge guide position EP (step S3). At step S3, if it is predicted that the slope SL of the paper P is large, that is, the current edge guide position EP is larger than the skew removal performing edge guide position PEP, it is judged that the skew removal should be performed, and the skew removal is performed (step S4).

If the skew removal is completed at step S4, or if NO at step S3, the paper P is transported by the transport mechanism 8 to perform the printing. And, one side of the paper P, that is, the leading position of the carriage 53 at a home position is detected (step S5), and the trailing position of one side of the paper P is detected (step S6), so that the slope SL of the paper P is derived by the slope deriving unit 25*b* (step S7). Then, it is judged whether the magnitude of the slope SL of the paper P is larger than 1° (step S8), and if YES, the skew removal performing edge guide position PEP stored in the nonvolatile memory 29 is updated with the edge guide position EP which is used when the slope SL of the paper is derived at step S7. The updated skew removal performing edge guide position PEP is stored in the nonvolatile memory 29, and the processing is completed (step S10).

Meanwhile, if NO at step S8, the current skew removal performing edge guide position PEP is not updated, and is stored in the nonvolatile memory 29, and the processing is completed (step S10). Although the processing of step S10 is performed for every printing, the processing of step S10 may be performed when the power of the apparatus is turned OFF.

As described above, in this embodiment, the skew removal performing edge guide position deriving unit 25*c* derives the guide width-slope relation to predict the slope estimation value of the paper P with respect to the edge guide position EP obtained by the guide position obtaining unit 25*a*, on the basis of the edge guide position EP obtained by the guide position obtaining unit 25*a* and the slope SL of the paper P derived by the slope deriving unit 25*b*. And, when the subsequent sheet of paper P is printed, the skew removal performing control unit 25*d* obtains the slope estimation value of the paper P in the current edge guide position EP obtained by the guide position obtaining unit 25*a* from the guide width-slope relation stored in the nonvolatile memory 29, and judges whether the skew removal is performed. The skew may occur at the paper P transported by the transport mechanism due to a phenomenon which is unrelated to the structure of the device, for example, the use environment of the ink jet printer 1 after shipping of the device, a user's habit of adjusting the guide width of the edge guide 6 voluntarily to feed the paper, or the like. However, with the above configuration, when the subsequent sheet of paper P is printed, since the skew removal performing control unit 25*d* controls the printing controller 28 to perform the skew removal by the skew removal performing control unit 25*d* judging that the skew removal should be performed, the skew of the paper P which caused by the user's habit or the like can be settled.

In addition, the guide width-slope relation stored in the nonvolatile memory 29 is updated on the basis of the newly derived guide width-slope relation whenever the paper P is printed. Even though the use circumference of the ink jet printer 1 is changed or the guide width of the edge guide 6 is readjusted by the user, the skew removal performing control unit 25*d* always judges whether or not the skew removal is to be performed, on the basis of the new guide width-slope relation, so that the skew occurring at the paper P can be reliably settled.

Also, when the paper P is printed, the skew removal performing control unit 25*d* judges whether or not the skew removal is to be performed, on the basis of the edge guide position EP obtained by the guide position obtaining unit 25*a* and the skew removal performing edge guide position PEP which is determined by the skew removal performing edge guide position deriving unit 25*c* based on the slope estimation value of the paper P obtained from the derived guide width-slope relation, the skew removal performing edge guide position PEP being a threshold value of a reference to judge whether or not the skew removal is to be performed. Therefore, whether or not the skew removal is to be performed is judged only by comparing the current edge guide position EP with the threshold value of the skew removal performing edge guide position PEP, in order to try and simplify the processing.

Also, the nonvolatile memory 29 is stored with the guide width-slope relation and the skew removal performing edge guide position PEP for at least each paper size of the paper P, so that the skew removal performing control unit 25*d* can judge whether or not the skew removal is to be performed, on the basis of the guide width-slope relation or the skew removal performing edge guide position PEP which corresponds to the paper size of the paper P, and can perform the judgment accurately. Therefore, it is of practical use.

It is noted that the invention is not limited to the above-described embodiment, and several modifications can be achieved without deviating from the scope of the invention. For example, although, in the above embodiment, a description is provided by taking, as a printing apparatus of the invention, the ink jet printer 1 which performs color printing, the invention may be applied to a printing apparatus, such as an ink jet printer performing monochrome printing or an electrophotographic printer of ink cartridge type, a printing apparatus such as a network printer with a cable LAN, a printing apparatus such as a combination machine with a FAX or scanner, and a printing apparatus of another printing type besides the ink cartridge type. In other words, the invention may be widely applied to a printing apparatus including the auto sheet feeder 3.

In addition, although, in the above embodiment, several functions of performing skew removal of the paper according to the invention are performed by software, these functions may be performed by hardware. With the above configuration, the same effect as the above effect can be achieved. Also, the edge guide 6 is adapted to move only one movable edge guide 6*b*, but both edge guides can be moved.

What is claimed is:

1. A paper feeding device for feeding a sheet of printing paper to a printing position of a printing apparatus in order to print the paper, the paper feeding device comprising:

a paper tray that stores plural sheets of the paper;

a transport unit that transports the paper from the paper tray to the printing position;

a guide unit that is provided to adjust a guide width in accordance with the width of the paper which is substantially perpendicular to a feeding direction of the paper transported by the transport unit, and to guide the paper which is transported from the paper tray by the transport unit;

a guide width detecting unit that detects the guide width;

a slope deriving unit that derives a slope of the paper to the feeding direction of the paper when the paper is printed;

a skew removal unit that performs skew removal to cancel the slope of the paper before the paper is transported to the printing position by the transport unit;

a guide width-slope relation deriving unit that derives a guide width-slope relation to estimate a slope estimation value of the paper in the guide width, based on the guide width detected by the guide width detecting unit and the slope of the paper derived by the slope deriving unit;

a memory unit that stores the guide width-slope relation derived by the guide width-slope relation deriving unit;

a judgment unit that obtains the slope estimation value in the current guide width detected by the guide width detecting unit from the guide width-slope relation, when a subsequent sheet of paper is printed, and judges whether or not the skew removal is to be performed by the skew removal unit; and a control unit that controls the skew removal unit to perform the skew removal, when the judgment unit judges that the skew removal has to be performed.

2. The paper feeding device according to claim 1, further comprising:

an update unit that updates the guide width-slope relation stored in the memory unit based on the guide width-slope relation derived by the guide width-slope relation deriving unit, whenever the paper is printed.

3. The paper feeding device according to claim 1, further comprising:

a threshold value determining unit that determines a threshold value of the guide width which is a reference to judge whether or not the skew removal is to be performed, based on the slope estimation value of the paper which is obtained from the guide width-slope relation, wherein the judgment unit judges whether or not the skew removal is to be performed by the skew removal unit, based on the guide width detected by the guide width detecting unit and the threshold value determined by the threshold value determining unit, when the paper is printed.

4. The paper feeding device according to claim 1, wherein the memory unit stores the guide width-slope relation for at least each paper size of the paper.

* * * * *